US005398567A

United States Patent [19]

Specht

[11] Patent Number: 5,398,567

[45] Date of Patent: Mar. 21, 1995

[54] TRIGGER LEVER ARRANGEMENT

[75] Inventor: Glenn E. Specht, Massillon, Ohio

[73] Assignee: The Hoover Company, North Canton, Ohio

[21] Appl. No.: 41,266

[22] Filed: Apr. 1, 1993

[51] Int. Cl.[6] ..... G05G 1/04; A47L 3/00

[52] U.S. Cl. ..... 74/523; 74/528; 74/527; 74/543; 74/545; 15/361; 15/410

[58] Field of Search ..... 74/557, 523, 543, 544, 74/527, 528; 15/410, 361, 329; 239/310, 413

[56] References Cited

U.S. PATENT DOCUMENTS

| | | | |
|---|---|---|---|
| 2,635,276 | 4/1953 | Norris | 15/320 |
| 3,122,773 | 3/1964 | Little | 15/503 |
| 4,498,214 | 2/1985 | Oxel | 15/320 |
| 4,558,823 | 12/1985 | Groth | 239/413 |
| 4,624,027 | 11/1986 | Martin | 15/410 |
| 4,720,890 | 1/1988 | Jacob | 15/410 X |
| 4,845,803 | 7/1989 | King | 15/410 |
| 4,875,879 | 10/1989 | Bunyea et al. | 15/410 |
| 4,876,763 | 10/1989 | Cho et al. | 15/329 |
| 4,947,512 | 8/1990 | Lackner et al. | 15/329 |
| 5,083,340 | 1/1992 | Takahashi et al. | 15/410 |
| 5,187,832 | 2/1993 | Meyer et al. | 15/410 X |

FOREIGN PATENT DOCUMENTS

| | | | |
|---|---|---|---|
| 660935 | 4/1963 | Canada . | |
| 973596 | 8/1975 | Canada . | |
| 0286203 | 10/1988 | European Pat. Off. | 15/410 |
| 3207099 | 9/1983 | Germany | 15/410 |

*Primary Examiner*—Vinh T. Luong

[57] ABSTRACT

A handle mounted trigger lever which is utilized as a solution release mechanism in an extractor is provided. The trigger switch as an 'off' position and two 'on' positions with the second 'on' position obtainable by the depression of a release button, the release button being in a normally obstructing relationship with the trigger switch's movement in its first position. The release button includes a deformable obstructing portion which abuts with the trigger lever and limits trigger lever swing at the first 'on' position. This obstructing portion may then be moved to a non-interfering relationship be deformation of the obstructing portion of the release button so that the trigger lever may then be moved to the second 'on' position.

6 Claims, 4 Drawing Sheets

TRIGGER LEVER ARRANGEMENT

BACKGROUND OF THE INVENTION

1. Field of the Invention

This invention relates to trigger lever arrangements and, more particularly: to a handle mounted trigger lever arrangement utilized for solution release in an extractor.

2. Summary of the Prior Art

The use of a handle mounted trigger lever arrangement for solution dispensing in an extractor or the like is old and well known. Such arrangements are even known to provide more than one step in the "throw" of the usual connecting Bowden wire cable or linkage to vary the strength of a cleaning solution flow to the floor or carpet. However, these arrangements or other known multi-position trigger lever arrangements utilize a somewhat cumbersome disposition of, e.g., two triggers, adjusting nuts or a complicated trigger, itself, to obtain this function. Accordingly, it would be advantageous to provide a simply operated and functioning trigger lever arrangement that was easily user controlled and quickly adjusted to its multi-positions.

It is, therefore, on object of the present invention to provide an improved trigger lever arrangement.

It is an additional object of the invention to provide such a trigger lever arrangement in an extractor or the like.

It is a further object of the invention to provide a trigger lever easily released to a second position of adjustment by operation of an adjacent button.

It is a still further object of the invention to provide a trigger lever arrangement having a deformable button operated member which is, in at least one position of the trigger lever, interposed in the volume swept by the trigger lever to prevent additional unaided movement by it.

It is an even further object of the invention to provide a deformable button operated member which may be deformed to permit release swinging of a trigger lever member adjacent to it.

SUMMARY OF THE INVENTION

A lever trigger arrangement may be mounted, for example, on the handle of an extractor and connected by a Bowden wire cable or other linkage to a dispensing valve located in a main body of the extractor. The dispensing valve may have, as is well known in the art, at least three positions including essentially a closed position, a partial flow position or a heavier flow position. These three functions or even a valve movable from a closed position to a wider and wider open flow position depend on the position of the valve's actuating parts which, in turn, depend on, the positioning of the Bowden wire cable or actuating linkage as directed by the positioning of the trigger lever arrangement.

A trigger lever of the trigger lever arrangement is pivotally mounted on the handle to movably control the Bowden wire cable or other linkage. Between the functional sweep of this trigger lever and the handle a deformable member carrying an integral button is disposed. When the trigger is in an off position (urged by spring loading in the dispensing valve), it does not engage the deformable member. When it has been pivoted by operator action towards the handle, a projection on it abuts a projection on the deformable button member stopping its swing but providing the dispensing valve with a reduced flow characteristic. Further swinging of the trigger lever towards its handle to thereby obtain full flow is permitted by a reciprocation of the button portion of the deformable member inwardly compressing it and placing its projection generally below the projection on the trigger lever. The trigger lever can then swing further towards the handle with its projection acting as a camming means against the projection on the deformable button member to thereby provide a fuller flow characteristic of the dispensing valve.

BRIEF DESCRIPTION OF THE DRAWINGS

Reference may now be had to the accompanying Drawings for a better understanding of the invention, both as to its organization and function, with the illustration only showing a preferred embodiment, but being only exemplary and in which.

DETAILED DESCRIPTION OF THE INVENTION

Figure 1:
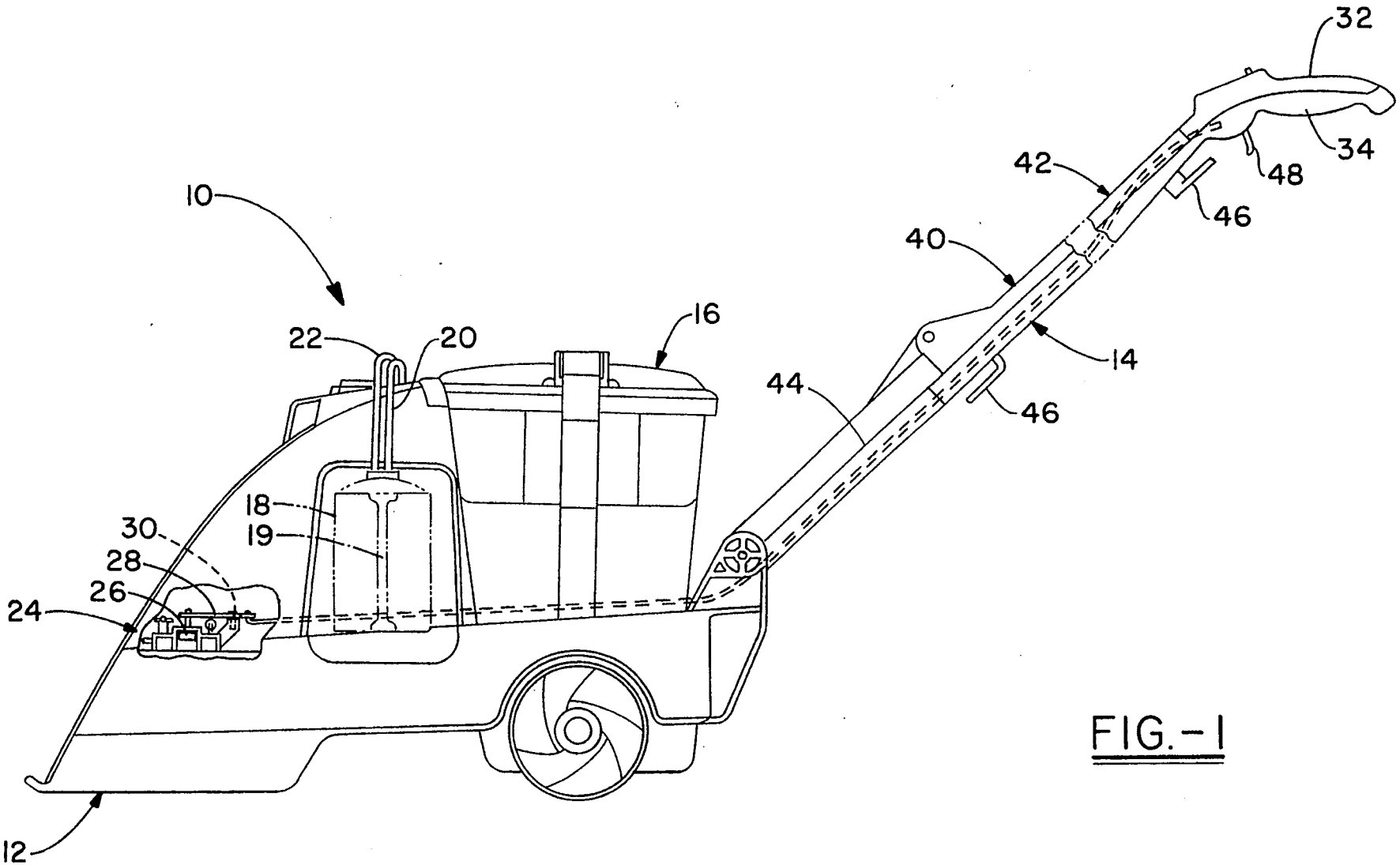
FIG. 1 is a side elevational view of an extractor which might incorporate the invention.

There is shown in FIG. 1 an extractor 10 utilized to provide and remove, by suction, cleaning solution from a floor or carpet. As is usual the extractor 10 includes a suction and solution applying nozzle 12 and a handle 14 extending up from a main body 16 of the extractor 10. This main body houses a detergent solution bottle 18 having a handle 19. This bottle is pressurized by the extractor's motor fan system (not shown) through a hose 20. A solution applying hose 22 extends outwardly the bottle 18 and then leads downwardly (not shown) through the main body 16 to attach (not shown) to a dispensing valve 24 mounted in the main body 16 above but adjacent to the nozzle 12.

The dispensing valve 24 forms no part of this invention but may include a slider 26 tie, set provides through mounted pins or the like a pinching action on flexible tubing (not shown) within the dispensing valve 24. This pinching, as is conventional, opens and closes flexible tubing (not shown) within it to provide a lesser or greater flow of solution (e.g., a lesser or greater concentration of detergent) to the nozzle 12.

Another usable valve of this nature but having a functioning pivoting pinching motion is seen in U.S. Pat. No. 4,575,007, issued Mar. 11, 1986. A crank arm 28, pivoted at 30 on the housing of the dispensing valve 24, could directly drive this pivoted pinching motion or it could be connected by the equivalent of or a pin and slot connection (not shown) to drive the slide 26 of dispensing valve 24 in an in-line reciprocatory manner. In any event a valve which provides an added flow of detergent to nozzle 12 upon swinging of crank arm 28 in a clockwise direction when viewed from above will satisfy the requirements of the invention.

Figure 2:
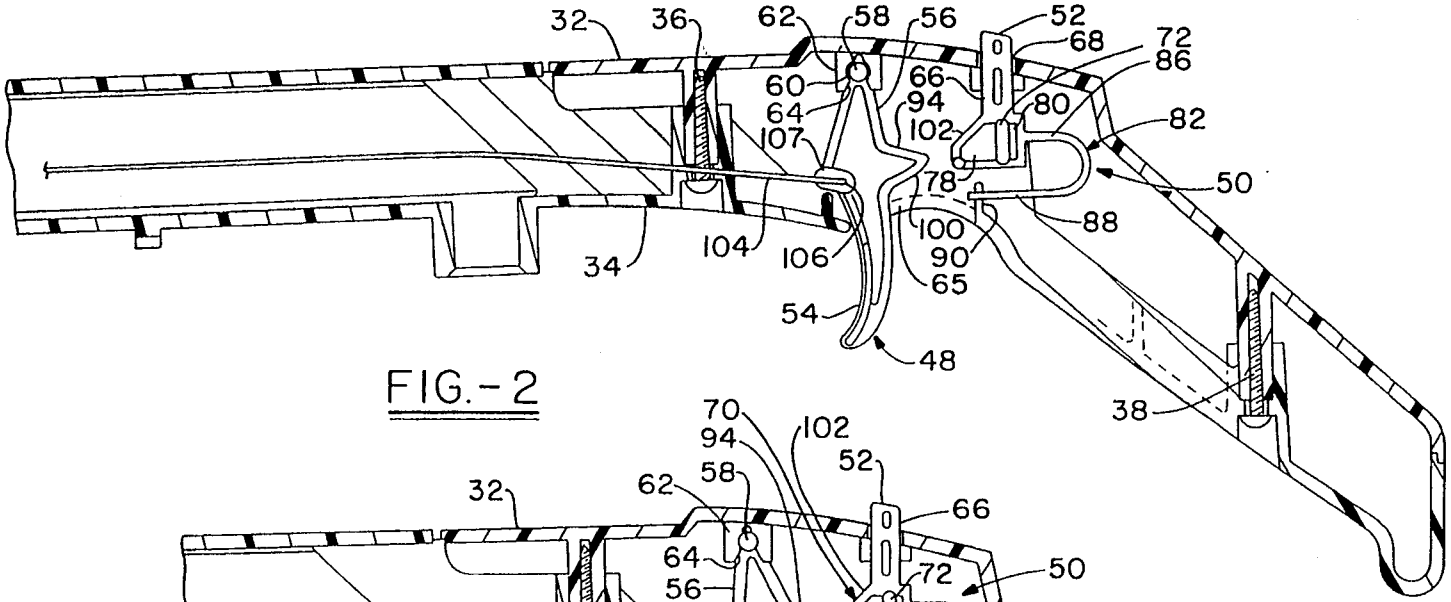
FIG. 2 is a partial vertical, medial cross-sectional view of the handle of the extractor of FIG. 1 but showing the trigger lever arrangement in full lines with the trigger lever in dispensing valve closed position.

The handle 14, at its outer end, is split generally medially vertically into upper and lower handle sections 32, 34. These handle sections may be conveniently attached adjacent the button end of upper handle section 32 by a lower screw 36 FIG. 2) and by an upper screw 38 to fix the upper ends at the handle 14. The lower handle section 34 is a continuation of a lower main handle section 40 while the upper handle section terminates slightly beyond the screw 36 and joins at this location slightly telescopically to an upper main handle section 42. These two main handle sections extend downwardly toward the main body 16 to join by any conventional fastening means (not shown) to a lower two piece handle stub 44 that forms the remainder of the handle 14. A pair of cord hanger members 46, 46 are also mounted on the handle 14.

Turning now to the inventive aspects of this Application (FIGS. 2–5), there is shown a trigger lever 48 and a deformable member 50 including a button 52. These two parts; ideally, are made of plastic as many or most of the other parts of the extractor 10 may be.

The trigger lever 48 includes a finger contacting portion 54 in the shape more or less of the trigger on a gun and an integral, inwardly extending roughly triangularly portion 56. This portion includes a pair of transversely extending pivot pins 58, 58 (only one shown) that extend sidewardly out of the surface of the triangular portion 55 to engage by a snapping action in bores 60, 60 (only one shown) in open arm portions 62, 62 (only one shown) integral with upper handle section 32. Each of the pins 58 is led into its respective bore 60 by an open V-section 64 in each open arm 62. The trigger operating portion 54 extends downwardly and outwardly of the handle 14 through a trigger slot 65.

The deformable member 50 includes an upwardly extending stub 66 surmounted by the button 52, with upwardly extending stub 66 passing through a bore 68 in upper handle portion 32 to permit operator access to the button 52. Below the stub 66: the deformable member 50 widens out to a trapezoidal shape 70 having a transversely extending guide web 72, slightly rear of center. This web rides in a pair of opposed slots 73, 73 (only one shown) formed in upper handle section 32. This upper portion includes a series of cutouts 74, 76, 78 and 80 that conserve material that might be needed for deformable member 50.

Deformable member 50 also includes a U-shaped spring 82 which extends medially outwardly and rearwardly from a flat side 84 of trapezoidal shape 70 of deformable member 50. Opposite an attached leg 86 of the U-shaped spring 82 is a freely extending leg 88 which is captured compressingly between a pair of upwardly extending ribs 90, 90 (only one shown) integral with lower handle portion 34, so that this leg rides on a ridge 92 formed by steps in these ribs.

Figure 3:
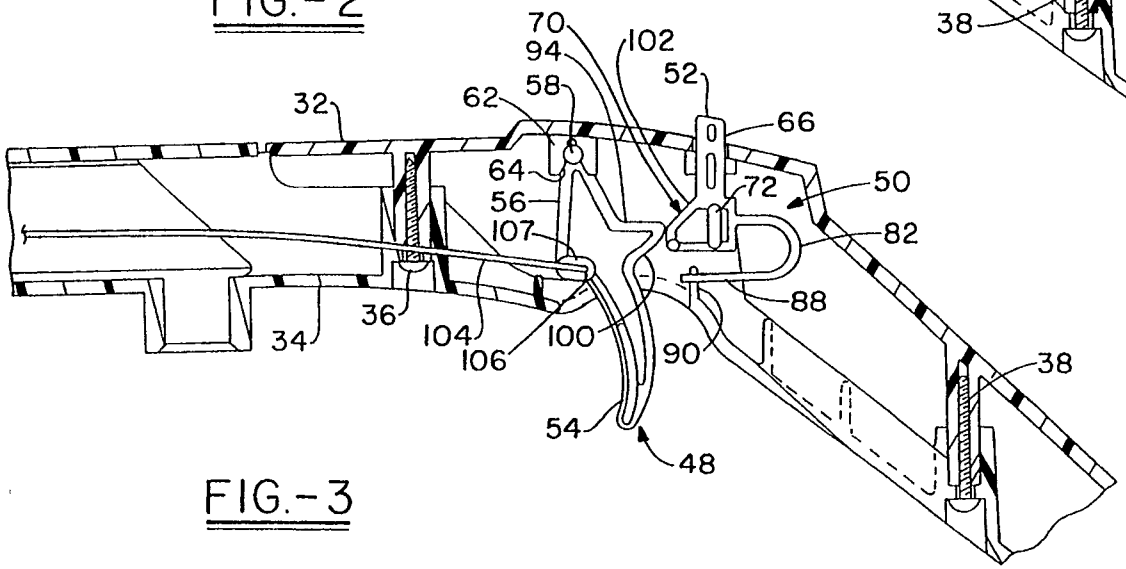
FIG. 3 is a view similar to FIG. 2 with the trigger ever in its intermediate, dispensing valve partial flow condition.
Figure 4:
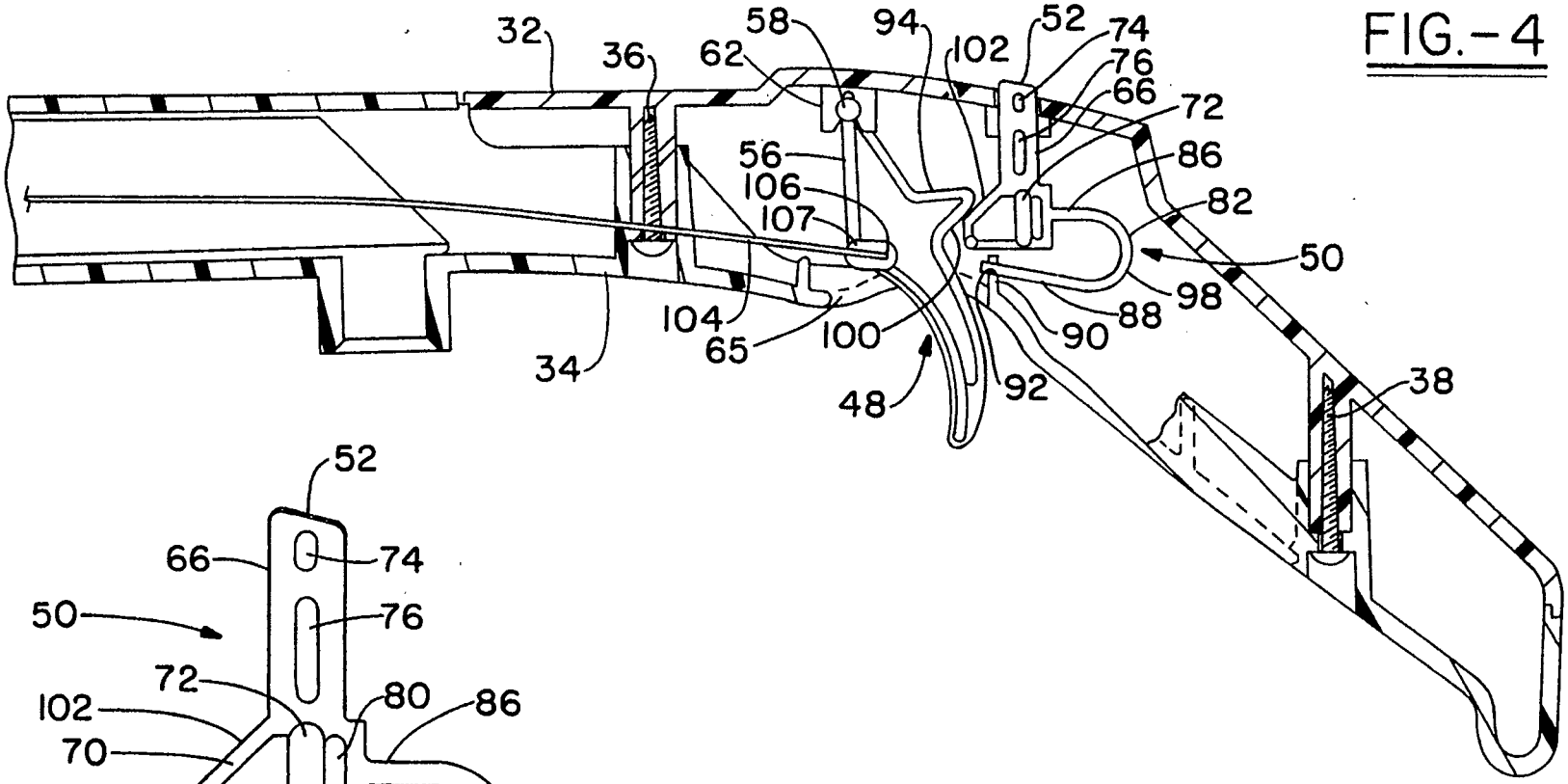
FIG. 4 is a view similar to FIGS. 2 and 3 but with the trigger lever in its most inwardly swung position to provide full flow to the dispensing valve.
Figure 5:
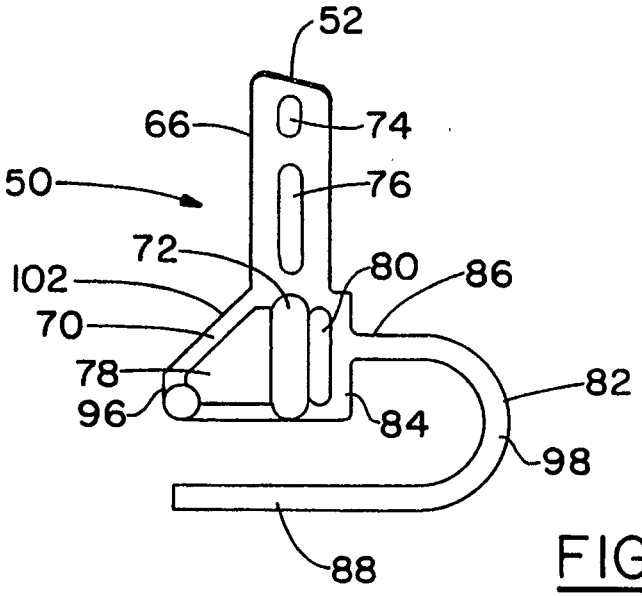
FIG. 5 is a side elevational view of the deformable member with its integral button.
Figure 6:
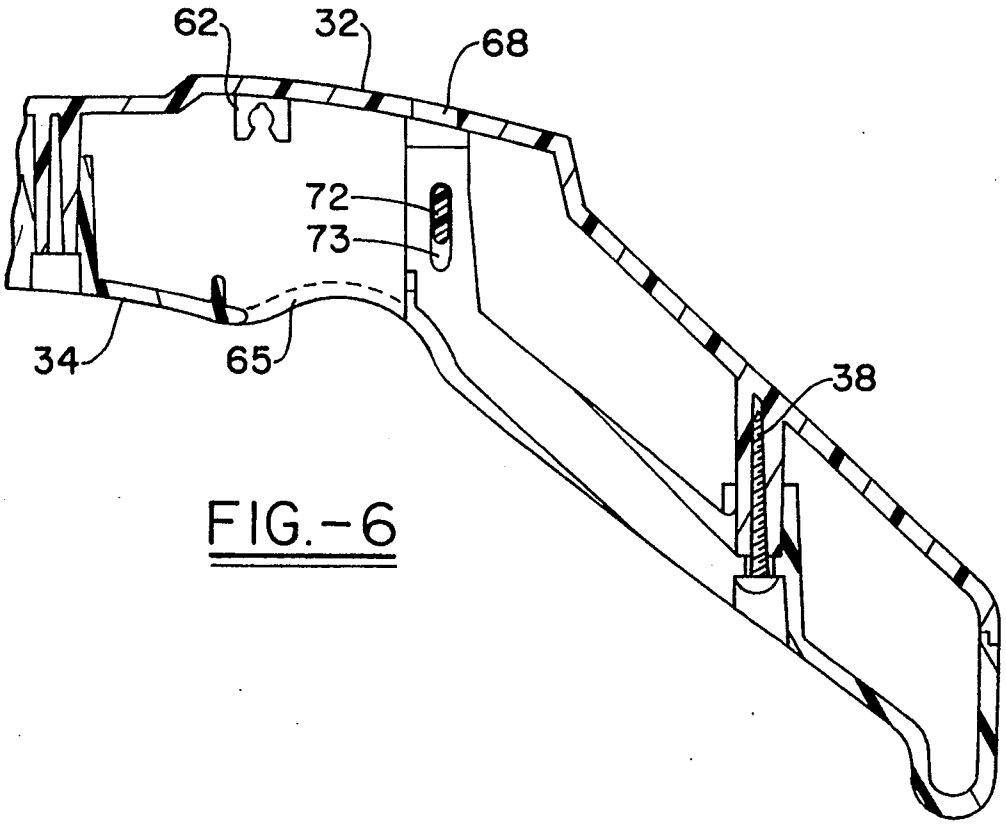
FIG. 6 is a partial vertical, medial cross-sectional view of the upper handle portion and one of its included slots.

When the trigger lever 48 (FIG. 2) is at its most forward position, as urged by spring urging (not shown) in the dispensing valve 24 and turned, therefore, furthermost clockwise from then handle section 34 it is spaced from and does not engage the deformable member 50 so that it may be urgingly turned counterclockwise by the finger of the operator until it engages this deformable member 50 (FIG. 3). During this movement the dispensing valve 24 may slowly open to a first solution dispensing position.

At this position, it can be seen that a rearwardly extending triangularly shaped integral projection 94 on trigger lever 48 has come into abutment with another and opposite flat 96 of trapezoidal shape 70 off deformable member 50. Because of the closed reinforced configuration of trapezoidal shape 70 and its guide web 72, little, if any, deformation of this member takes place so that trigger lever 48 is arrested in its counterclockwise movement until button 52 is depressed.

Depression of the button 52 drives the stem 66 on deformable member 50 inwardly and downwardly. This action bendingly deflects its free leg 88 and a bight 98 of U-shaped spring 82 so that the deformable member 50, essentially, translates downwardly, placing an angled leg 100 of the projection 94 of trigger lever 48 immediately above a portion of the trapezoidal shape 70 as represented by an angled leg 102 of the deformable member 50. In this location (FIG. 4) the trigger lever 48, if need be, is free to turn further counterclockwise as it abuttingly and cammingly engages the deformable member 50 so as to move to its most open position. It reaches its movement limit, based on a reverse backward pull imposed on it by a Bowden wire cable 104 or a convenient trigger stop (not shown).

Bowden wire cable 104 is attached to trigger lever 48 by being hooked through a forwardly disposed bore 106 thickened portion 107 in it. The Bowden wire cable 104 then extends, as is usual, downwardly through the handle 14 and main body 16 to be attached to the pivoted actuating crank arm 28.

It should now be clear that the objects of the invention set out in the beginning portion of this Specification have been fully met. It should also be apparent that many modifications could be made to it which wold still fall within its spirit and purview, such as the use of a slidable trigger lever in place of a pivoting one.

What is claimed is:

1. A floor care appliance having a trigger lever arrangement including:

(a) a valve structure providing for application of cleaning solution for said floor care appliance;

(b) a movable control means for actuating said valve structure;

(c) a trigger lever pivoted to said floor care appliance and moving said control means;

(d) said trigger lever having a projection;

(e) a button abutting with said trigger lever projection to limit said pivoting of said trigger lever;

(f) said button having a flat abutting first face against which said projection abuts in a first position of said trigger lever;

(g) said button having an angled second face;

(h) said button including a spring; and (i) said projection cammingly engaging said second face of said button at a second position of said trigger lever after inward reciprocation of said button and deformation of said spring.

2. The floor care appliance having a trigger lever arrangement as set out in claim 1 wherein:

(a) said spring takes the form of a U-shape integral with said button body portion includes an integral U-shaped spring.

3. The trigger lever arrangement for a floor care appliance according to claim 1 wherein:

(a) said button is reciprocatorily mounted in a handle of said floor care appliance in an in line reciprocatory manner.

4. A floor care appliance having a trigger lever arrangement including:

(a) a control means for applying a cleaning solution for said floor care appliance;

(b) a trigger lever pivotally attached to said control means for initiating application of a flow of said cleaning solution by said floor care appliance and for increasing said flow of cleaning solution by greater and greater pivoting;

(c) a button movably mounted on said floor care appliance adjacent said trigger lever;

(d) said button being disposed adjacent said trigger lever;

(e) said trigger lever when moving to said cleaning solution applying position abuttingly engaging said button to provide a first partly pivoted position of said trigger lever;

(f) said button reciprocatorily mounted in a handle of said floor care appliance;

(g) said trigger lever pivotally mounted to said handle;

(h) said trigger lever including a portion disposed in said handle having a projection;

(i) said projection abuttingly engaging with said button in said first position of said trigger lever;

(j) said button including a relatively flat abutting first face against which said projection abuts in said first position of said trigger lever;

(k) said button including a cammable, angled second face; and (l) said projection engaging said second face at a second position of movement of said trigger lever after additional inward reciprocation of said button.

5. The trigger lever arrangement for a floor care appliance according to claim 4 wherein:

(a) said button includes a portion formed by an integral U-shaped spring; and (b) said U-shaped spring has a free leg that bendingly deforms to place said angled face into cammingly confronting relationship with said projection when said button is additionally moved inwardly relative to said handle.

6. The trigger lever arrangement for a floor care appliance according to claim 4 wherein:

(a) said button is reciprocatorily mounted in an in line relationship relative to said floor care appliance.

* * * * *